United States Patent [19]

Hosokawa et al.

[11] 4,429,305

[45] Jan. 31, 1984

[54] LIQUID CRYSTAL DISPLAY SYSTEM

[75] Inventors: Minoru Hosokawa; Koichi Oguchi; Satoru Yazawa, all of Suwa, Japan

[73] Assignee: Kabushiki, Kaisha Suwa Seikosha, Tokyo, Japan

[21] Appl. No.: 154,354

[22] Filed: May 29, 1980

[30] Foreign Application Priority Data

May 30, 1979 [JP] Japan ..... 54-67233

[51] Int. Cl.[3] ..... G09G 3/36

[52] U.S. Cl. ..... 340/784; 340/719; 340/798

[58] Field of Search ..... 340/784, 166 EL, 798, 340/784, 718, 719, 825.79, 825.81, 825.83, 825.86

[56] References Cited

U.S. PATENT DOCUMENTS 3,862,360 1/1975 Dill et al. ..... 178/7.3 D 4,112,333 9/1978 Asars et al. ..... 340/166 EL 4,239,346 12/1980 Lloyd ..... 340/719

*Primary Examiner*—Marshall M. Curtis

*Attorney, Agent, or Firm*—Blum, Kaplan, Friedman, Silberman & Beran

[57] ABSTRACT

A matrix liquid crystal display circuit includes a selecting transistor connected to the picture element and a capacitor for each picture element of the matrix. The other picture element and capacitor terminals connect to common electrodes and the transistor gates in each row connect to a common electrode. In each column a common source line connects to the sources of the transistors and a signal sampling circuit periodically applies an image signal to the source line of each column in sequence. No amplification is used between the sampling circuit and the transistor sources. Metallic leads serve as the source lines, but other circuits and components are integrated on a common substrate.

13 Claims, 6 Drawing Figures

FIG. 2 PRIOR ART
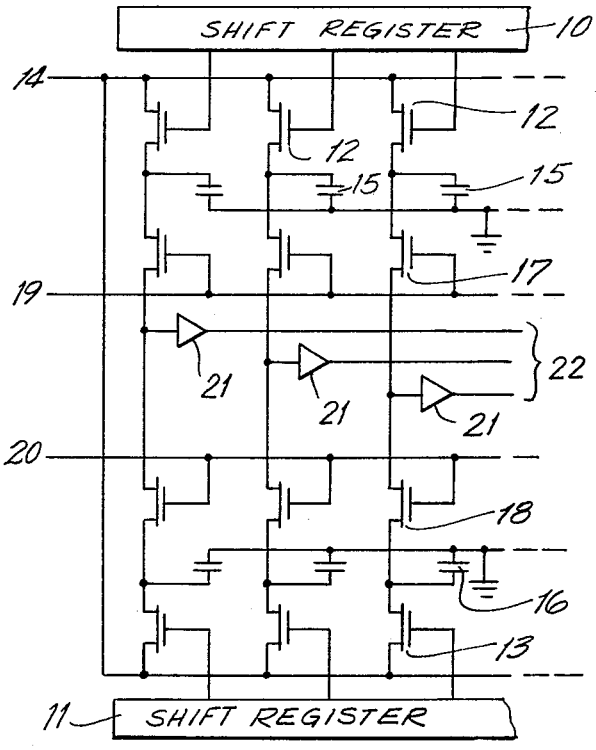
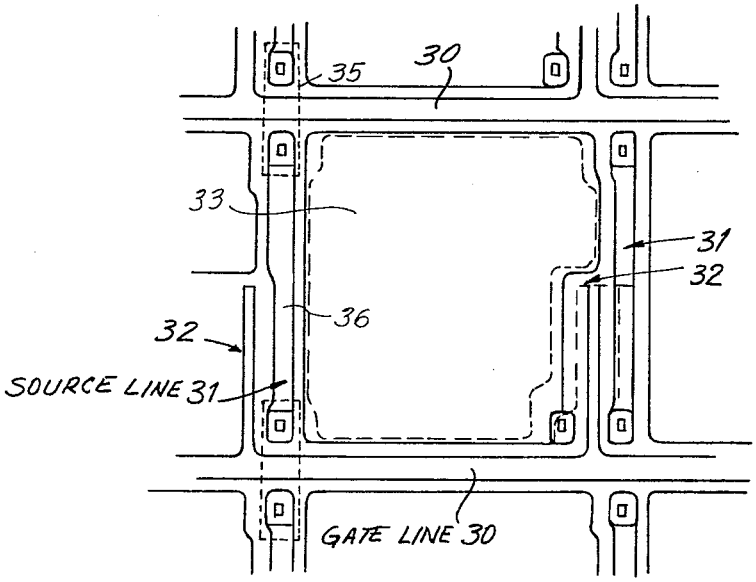
FIG. 3 PRIOR ART

FIG. 5
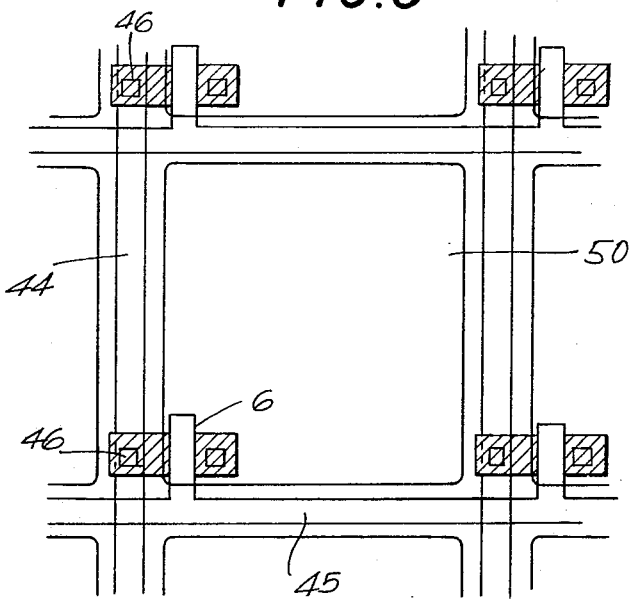
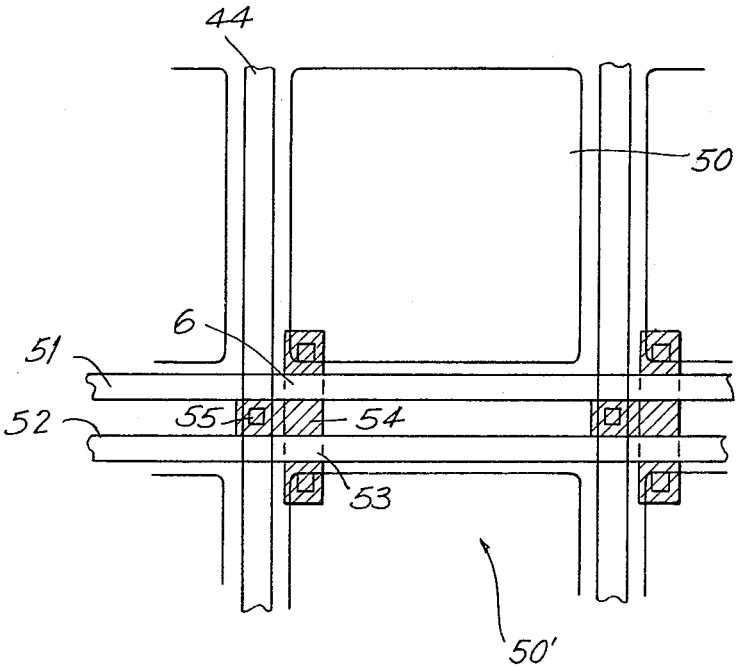
FIG. 6

LIQUID CRYSTAL DISPLAY SYSTEM

BACKGROUND OF THE INVENTION

This invention relates generally to a liquid crystal display circuit of the matrix type and more particularly to a circuit having a transistor and capacitor associated with each picture element. Further the invention relates to a circuit for sampling a series image signal for display on a row of picture elements, for supplying said image signal to the picture element electrode, for holding of the image signal and for writing the sampled signal on the picture element electrode of the display element.

When an image signal forming a picture, for example, a television signal, is inputted as a periodically serial signal to be displayed on a matrix image display system, it is necessary to distribute and apply the inputted image signals to the picture elements in the matrix in a periodic order. In order to simplify the circuit arrangement in the vicinity of the matrix display unit it is common to provide an image signal sampling and holding circuit for each column of the matrix whereby an image signal is sampled and held for each picture element of the same row. Then the signal is transmitted to each picture element electrode by a picture element selecting transistor in the same row. An amplifier is commonly used for each column of the matrix. If a matrix has two hundred columns, two hundred amplifiers are required, and if a television picture is to be displayed in a manner similar to a cathode ray tube, at least five hundred amplifiers are required. The power consumed by the amplifiers is high and far more power is used in amplification than is required for driving the liquid crystals.

What is needed is a liquid crystal display circuit of the matrix type which uses low power and minimizes the number of components required for effective image display.

SUMMARY OF THE INVENTION

Generally speaking, in accordance with the invention, a liquid crystal display circuit especially suited for a matrix display is provided. The circuit includes a selecting transistor connected to the picture element and a capacitor for each picture element of the matrix. The other picture element and capacitor terminals connect to common electrodes and the transistor gates in each row connect to a common electrode. In each column a common source line connects to the sources of the transistors and a signal sampling circuit periodically applies an image signal to the source line of each column in sequence. No amplification is required between the sampling circuit and the transistor sources. The transistor circuits, the sampling circuits and a circuit for driving the gates of the transistors are formed on a single crystalline semi-conductor substrate. The sampling circuit includes a bi-directional switch having a P-type and an N-type MOSFET connected in parallel. Capacitors are not needed in the signal sampling circuits to hold the signal as in an alternating drive circuit because the circuits in accordance with this invention have a low source line capacity which provides a rapid response to incoming signals and makes storage capacitors unnecessary.

Accordingly, it is an object of this invention to provide an improved liquid crystal display circuit requiring no amplifiers associated with each picture element.

Another object of this invention is to provide an improved liquid crystal display circuit which has a rapid response time and can display image signals without delay.

A further object of this invention is to provide an improved liquid crystal display circuit wherein inherent capacity of circuit elements is used to replace actual capacitor elements.

Still another object of this invention is to provide an improved liquid crystal display circuit wherein transistors, sampling circuits and drive circuits are formed on a single integrated circuit substrate.

Still other objects and advantages of the invention will in part be obvious and will in part be apparent from the specification.

The invention accordingly comprises the features of construction, the combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which:

FIG. 2 is an image signal sampling circuit for use with the system of FIG. 1;

FIG. 3 is a plan view to an enlarged scale of a display picture element and associated circuit components;

FIG. 5 and FIG. 6 are plan views to an enlarged scale of display picture elements in accordance with this invention and suited to the circuit of FIG. 4.

DESCRIPTION OF THE PREFERRED EMBODIMENTS

This invention relates to a matrix liquid image display circuit having a transistor associated with each picture element. More particularly, it is related to sampling in a liquid crystal display circuit of a series image signal, such as a television signal. The picture elements are arranged in rows and columns and the signals are applied to the elements in each row in sequence.

When the image signals forming a picure are inputted as periodical serial signals to be displayed by a matrix image display system, it is necessary to distribute and apply the inputted image signals to the picture elements of the matrix in a periodical order. For the purpose of simplifying the actual physical arrangement of a circuit in the vicinity of a matrix display, it has been common to provide an image signal sampling and holding circuit for each column of the matrix. Thereby an image signal is sampled and held for each picture element in the same row and the sampled signals are transmitted to the picture element electrodes by picture element selecting transistors in the same row.

Figure 1:
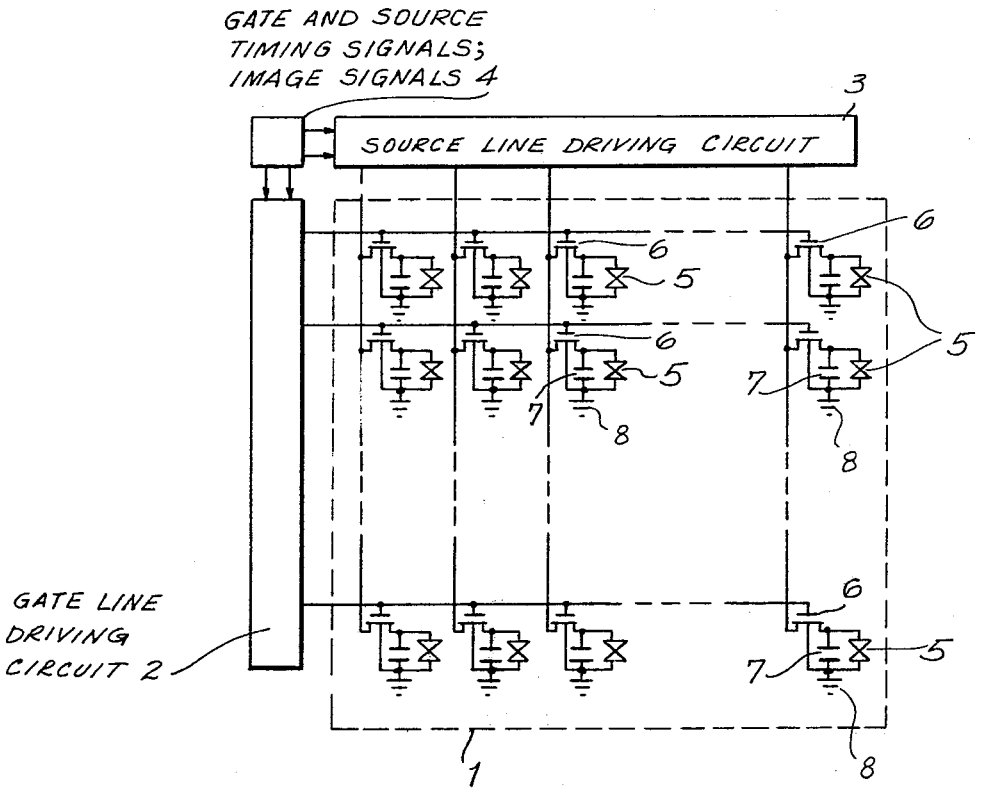
FIG. 1 is a semi-schematic diagram for a matrix liquid crystal display system of a type similar to the liquid crystal display circuit of this invention.

FIG. 1 is a semi-schematic block diagram of a liquid crystal matrix display system of a type related to the display circuit of this invention. A broken line defines a liquid crystal display unit 1 arranged in a matrix of rows and columns. A circuit 4 defines a television receiver, if a television picture is to be reproduced on the matrix display unit 1. If the display unit 1 is to be used as a graphic or general data display, the circuit 4 defines an interface circuit with a central data processing unit. The circuit includes a plurality of liquid crystal display elements 5, a picture element selecting transistor 6 associated with each display element 5, and a capacitor 7 associated with each picture element 5. A gate line driving circuit 2 connects to the gates of the picture element selecting transistors 6 such that all transistors 6 in one row receive the same signals from the gate line driving circuit 2. A source line driving circuit 3 connects to the sources of the picture element selecting transistor 6. Every transistor in the same column receives the same source driving signal simultaneously. The circuit 4 supplies timing signals to the source line driving circuit 3 and gate line driving circuit 2 and also provides the image signals to the source line driving circuit 3.

FIG. 2 illustrates a conventional source line driving circuit 3 of FIG. 1, for example, as disclosed in Japanese patent application laid open under number 50-10993. A shift register 10 transfers data for timing the image signal sampling, thereby providing for a series-parallel conversion of a video signal. A transistor switch 12, closes in response to a timing signal from the shift register 10, and samples an image signal delivered on line 14. A capacitor 15 holds the sampled data. Then the sampled image signal held by the capacitor 15 is selectively inputted through a switch 17 to an amplifier 21 on an output line 22. Each sampled image signal in sequence is delivered on a different parallel output line 22. Timing signals on line 19 control the transfer of the signal from the capacitors 15 to the output lines 22. The shift register 11, transistors 13, capacitors 16, and transistor switches 18, perform the same functions as the corresponding components 10, 12, 15, 17 described above. The two groups of components function alternately to sample image signals and output them to the amplifiers 21. The second set of components 11, 13, 16, 18 receive the image signal from line 14 and a timing signal for transfer to the amplifiers 21 on line 20.

FIG. 3 shows a known arrangement for a picture element selecting transistor 32, a source line 31 and a gate line 30 positioned in relation to a liquid crystal display element electrode 33. The source line 31 comprises metallic wiring 35 connecting the diffusion areas 36 for the sources of the picture element selecting transistors 32 beneath the gate line 30. Because the slew rate of the amplifier 21, or the distributed capacity and resistance of the source line wiring, is not sufficient to transmit the sample image signal properly to the corresponding picture element electrode, the circuit shown in FIG. 2 includes a pair of image sampling circuits in parallel, as described. In that way, while one of the sampling circuits is supplying a sampled signal output to the source lines 22, the other circuit samples a serial image signal input. Therefore, one part of the circuit is sampling while the other part is outputting. These circuit arrangements result in a highly complicated source line driving circuit 3 (FIG. 1) and an extremely large number of signals for controlling the line driving circuit 3. This is true, because it requires a pair of sampling circuits including doubled quantities of holding capacitors 15, 16, changeover switches 17, 18 for outputting sampled signals, an image signal amplifier 21 for each source line 22, and so on.

Moreover, the image signal amplifiers 21 are analog amplifiers which generally require a constant standby current. When the serial image signal supplied to the system is a television picure signal, the original signal has a band width about 4 MHz, and a horizontal scanning line has a period in the order of 60 microseconds. Accordingly, the amplifier 21 must be able to provide a varying output with a sufficiently faster response time than 60 microseconds in relation to the maximum amplitude of the image signal.

In the source wiring shown in FIG. 3, the capacity of the diffusion area forming the source line 31 possesses the greater part of the wiring capacity. A matrix display unit having a side length of several centimeters or greater is to be fabricated, it can be stated that a source capacity of at least several hundred pF joined together (picofarads), is required in this kind of circuit. Thus, the amplifier 21 has a capacitive load of approximately several hundred pF, and is required to amplify a signal having a band width of at least several ten KHz.

The amplitude of an output signal depends on the operating voltage of the liquid crystal and must be at least five volts. When a matrix has two hundred columns, two hundred amplifiers 21 are required. If a television picture is to be displayed in a manner similar to a cathode ray tube, at least five hundred amplifiers 21 are required. Anyone of ordinary skill in the art of circuit design will realize that in a circuit similar to that of FIG. 2, the power consumed by the amplifiers 21 is by far greater than the power required for driving the liquid crystal picture elements. This high power consumption by the amplifiers 21 negates the advantageous feature of a liquid crystal display unit, that is the low power consumption of the liquid crystal elements.

In view of the aforementioned disadvantages of the circuits of FIGS. 1–3, a liquid crystal display circuit in accordance with this invention provides a practically useful matrix type liquid crystal image display system having simplified peripheral circuits for the display unit. The matrix display circuit in accordance with this invention is capable of operation with reduced power consumption for sampling and holding image signals for writing the image signals on the picture element electrodes. The circuits in accordance with this invention have a particular advantage in that they can be fully integrated. There is a sharp reduction in the number of components involved, and circuits for adjusting differences among the amplifiers 21, and adjusting the rates of amplification and for drift, etc. are eliminated. Accordingly, the matrix circuit in accordance with this invention enables introduction of MOS integrated circuits into the peripheral circuits under conditions comparable to a conventional logic integrated circuit arrangement. Moreover, the matrix display circuit and the associated peripheral circuits are formed on a single semiconductor substrate.

Figure 4:
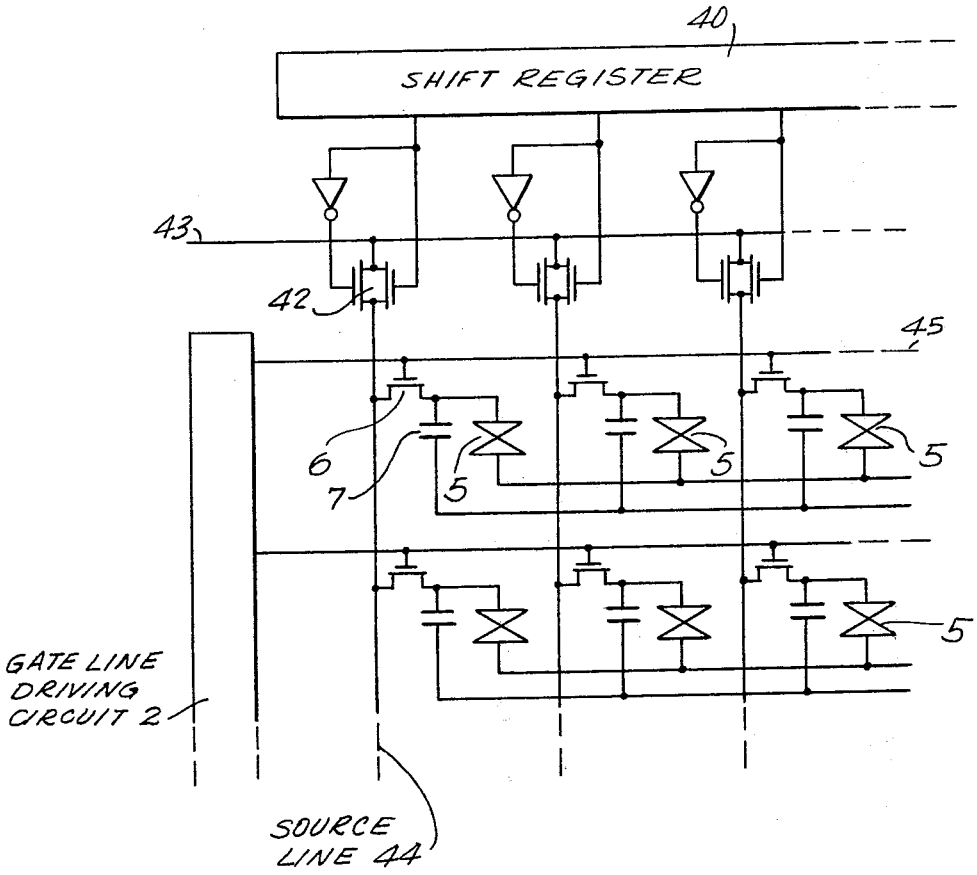
FIG. 4 is a partial circuit diagram of a liquid crystal display circuit in accordance with this invention.

FIG. 4 shows a portion of a circuit for a liquid crystal display unit in accordance with this invention. Picture elements 5 are arranged in rows and columns. The picture element electrode of each picture element 5 is connected to a transistor 6 and capacitor 7. In each row, the electrodes of the picture elements 5 opposite to the picture element electrode connected to the transistor 6, are connected to a common lead. The terminals of the capacitors 7 in the same row not connected to a transistor 6, are connected to another common lead. A shift register 40, similar to the shift register 10 in FIG. 2, provides a plurality of output signals for controlling the image signal sampling circuit. The serial image signals arrive on an image signal input line 43 and pass through bi-directional switches 42 to be applied to the sources of the transistors 6. The bi-directional switches 42 include a P-type and an N-type transistor connected in parallel with each other. The output of the switch 42 is the source line 44 connected to the picture elements 5 when the transistor 6 is short circuited. Every transistor 6 in th same row is short circuited at the same time by a driving signal from the gate line driving circuit 2 applied to the transistor gate by way of a gate line 45. When the signal from the shift register 40 closes the sampling switch 42 in one column, the serial image signal on the line 43 passes through the switch 42 and is present on the source line 44. The image signal is written on the picture element 5 in the driven column and in the row simultaneously driven by the gate line driving circuit 2. Each column in a driven row is provided with an image signal progressively in response to the progressive outputs from the shift register 40.

FIG. 5 shows specific details of a matrix arrangement. A picture element 50 is generally square in contour and has the transistor 6 located in one corner. A diffussion area forming the source of the picture element selecting transistor 6 is arranged as shown by oblique lines in FIG. 5, and the source is connected to a metallic source wire 44 through a contact hole 46. The metallic source wire 44 may be made, for example, of aluminum.

What is substantially different from the arrangement in FIG. 3 is the absence of any diffusion area for the source of the transistor included as a part of the source wiring. The sources (oblique lines) of all of the picture element selecting transistors 6 provided in each column of the matrix are directly connected to the output terminals of the image signal sampling switches 42 (FIG. 4) by means of the metallic wires 44. Generally, the resistance of a semi-conductor is two to three times higher than that of a conductor, and a source diffusion area having a high concentration has the so-called junction capacity which amounts to several pF per one hundred micrometers square.

Thus, the source line 31 of FIG. 3 is slow in transmitting an image signal because of the high wiring capacity-resistance as a whole. The circuit design of this invention enables a great reduction in the resistance of the writing circuit by at least two order of magnitude because the diffusion area is used exclusively as the transistor source. The diffusion area is not used as a lead conductor as in FIG. 3.

The sampling switch 42 which is a complementary bi-directional switch, is also capable of functioning as a low resistance switch within the range of operating voltages as compared to the single transistor switches shown in FIG. 2.

With reference to FIG. 4, operation of the circuit for sampling a serial input image signal input 43 and writing it on a picture element 5 is described. The shift register 40 delivers sample timing signals in sequence to each vertical column. This signal from the shift register 40 short circuits the complementary bidirectional switch 42 such that an image signal on the line 43 is rapidly passed from the input to the output terminals of the switch 42 and appears on the source line 44. As stated above, signals from the shift register 40 act on each column in a timed sequence. When the timing signal from the shift register 40 falls, the switch 42 is opened and an electric charge is isolated or stored on the source line 44 in a magnitude in accordance with the voltage potential of the image signal transmitted from the line 43 through the gate 42.

As already noted, the source line 44 has a very small capacity defined by a combination of the source diffusion capacity of the picture element transistors 6 and the floating capacity of the metallic wires 44 per se. Therefore, the total voltage potential on the source line 44 made of low resistance metal easily and quickly reaches a potential equal to the potential of the image signal while the switch 42 is in its short circuited condition. Thus, an image signal is sampled. Then, the picure element selecting transistors 6 in a row are short circuited by a signal on the line 45 produced by the gate line driving circuit 2. When the transistors 6 are short circuited, the image signal stored on the source line 44, as described above, is applied to each picture element electrode and written thereon. Because the resistance and load of the source line 44 are low as compared to any previously known circuit, the response is rapid and it is possible to accomplish both sampling of an image signal and writing the image signal on the picture element electrode within one horizontal scanning period of the serial image signal. It is not necessary to provide two sampling circuits in parallel as in FIG. 2 or to use holding capacitors 15, 16.

With the circuit in accordance with this invention, it is possible to realize more accurate writing of image signals on the picture elements. That is, as long as image signals are sampled for each column in a row during a horizontal scanning period, the gate signals for the same row are set so as to maintain the picture element selecting transistors 6 in that row in the short circuited ON condition. When the signals for all of the columns in a row have been sampled, that is applied to the picture elements 5, the gate line signals from the gate line driving circuit 2 are controlled to open or turn off the transistor 6. While the sampling switch 42 is short circuited and senses an image signal, the output terminals of the switch 42 remain connected to the picture element electrodes and to the capacitors 7 provided for the picture elements 5, through the source line 44. In this way the image signal is written on the picture element electrode during sampling insuring that an accurate image signal is given to the picture element 5. The capactive component of the picture element 5 and the capacitor 7 provided for each picture element 5 serve directly for holding an image signal and no other capacitor element is required anywhere else in the circuit for holding the image signal. Thus, the capacitive component of the source line per se can be minimized, and the power consumption of the circuit can be reduced to a value consisting solely of the power consumption required for the liquid crystal elements 5 and the parallel capacitor 7.

FIG. 6 shows a specific example of an alternative arrangement of picture elements 50 whereby the capacity of the source line 44 is reduced. Picture element selecting transistors 6 for picture elements 50, 50' have a common source which comprises a single diffusion area 54 shown with oblique lines. The common source is connected to a metallic source line 44 through a single contact hole 55. The capacity of the P-N junction for the source diffusion area of a picture element selecting transistor 6 possesses a major part of the source line capacity as discussed above. In accordance with the arrangement of FIG. 6, the number of source diffusion areas 54 connected to a source line 44 is reduced by half because a common source is provided for a pair of transistors 6 whereas each transistor 6 of FIGS. 3 and 5 had an independent source. The inherent capacity is also reduced to approximately half of the value of the other circuits because the unnecessary wiring capacity of the source line per se is reduced to half. Therefore the response time of the image signal sampling circuit is improved and power consumption of the display unit is decreased. Gate lines 51,52 are independent lines which intersect the diffusion area 54. Gate line 51 is part of the transistor for the upper picture element 50 and gate line 52 is part of the transistor for the lower picture element 50'.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A liquid crystal display circuit comprising:

a plurality of liquid crystal picture elements being arranged in a fixed pattern, each picture element being connected to a transistor formed on a substrate;

a plurality of common source lines on said substrate, the source of each said transistor being connected to one source line, a plurality of said transistor sources being connected to every source line, said source line having a low resistance;

a plurality of common gate lines, the gate of each said transistor being connected to one gate line, a plurality of said transistor gates being connected to every gate line;

switching means having input and output terminals associated with said source lines for sampling image signals, the output terminal of each said switching means being connected directly to an associated source line, image signals sampled by said switching means being held or stored by the capacitance of said source lines with said substrate, the low resistance of said source line providing a short time constant for charging said capacitance.

2. A liquid crystal display circuit as claimed in claim 1, wherein said source lines include metallic wiring directly connecting said output terminals of said switching means to said transistor sources connected to said source lines.

3. The liquid crystal display circuit as claimed in claim 1, wherein said means for sampling image signals for display is adapted to produce a short circuit between said input and said output to the source line associated with a picture element selected for display, whereby the image signal is rapidly and directly transmitted to said source line without amplification.

4. The liquid crystal display circuit as claimed in claim 3, and further comprising means for applying a potential signal selectively to said gate lines, application of said gate potential signal to a selected gate line short-circuiting the transistors with said gates connected to said selected gate line.

5. The liquid crystal display circuit as claimed in claim 3 or 4, wherein each said picture element includes a capacitive element and said image signal from said sampling means is stored by said capacitive element of said picture element and said inherent capacitor of said source line.

6. The liquid crystal display circuit as claimed in claim 1, and further comprising a circuit for driving said gate lines, and wherein said transistors, said means for sampling image elements, and said circuit for driving said gate lines are formed on a single crystalline semiconductor substrate.

7. A liquid crystal display circuit comprising:

a plurality of liquid crystal picture elements being arranged in a fixed pattern, each picture element being connected to a transistor;

a plurality of common source lines, the source of each said transistor being connected to one source line, a plurality of said transitor sources being connected to every source line;

a plurality of common gate lines, the gate of each said transistor being connected to one gate line, a plurality of said transistor gates being connected to every gate line;

circuit means for driving said gate lines;

means for selecting picture elements for display of image signals, said selecting means having an input and an output, said image signals being applied to said input, said output being connected directly to said source lines, said image signals being outputted from said selecting means to each said source line in a timed sequence, said means for selecting picture element includes a bidirectional sampling switch having a P-type and an N-type MOSFET connected in parallel.

8. The liquid crystal display circuit as claimed in claim 7, wherein said source line includes metallic wiring directly connecting said outputs of said means for selecting to said transitor sources connected to said source lines.

9. The liquid crystal display circuit as claimed in claim 8, and further comprising an insulating layer formed on said substrate, said metallic source wiring being isolated from said substrate by said insulating layer, said transistor sources being formed in said substrate as a diffusion layer, said insulated layer having a contact hole passing therethrough, said diffusion layer being connected to the associated source line through said contact hole, and a plurality of transistor sources being connected in parallel through a single contact hole.

10. The liquid crystal display circuit as claimed in claim 9, wherein said diffusion layer has a higher impurity content than said substrate.

11. The liquid crystal display circuit as claimed in claim 1, 4, 6 or 9, wherein said fixed pattern includes rows and columns.

12. The liquid crystal display circuit as claimed in claim 11, wherein the sources of transistors associated with picture elements in the same column are connected to the same source line, and the gates of transistors associated with picture elements in the same row are connected to the same gate line.

13. A liquid crystal display circuit as claimed in claim 2, and further comprising an insulating layer formed on said substrate, said metallic source wiring being isolated from said substrate by said insulating layer, said transistor sources being formed in said substrate as a diffusion layer, said insulated layer having a contact hole passing therethrough, said diffusion layer being connected to the associated source lines through said contact hole.

* * * * *